US006050106A

United States Patent [19]

Yamamoto et al.

[11] Patent Number: 6,050,106

[45] Date of Patent: Apr. 18, 2000

[54] ULTRA HIGH PURITY NITROGEN AND OXYGEN GENERATOR UNIT

[75] Inventors: Takao Yamamoto; Naohiko Yamashita, both of Hygo-ken, Japan

[73] Assignees: L'Air Liquide; Societe Anonyme pour l'Etude et l'Exploitation des Procedes Gorges Claude, both of Paris, France

[21] Appl. No.: 09/168,611

[22] Filed: Oct. 9, 1998

[30] Foreign Application Priority Data

Oct. 14, 1997 [JP] Japan ..... 9-280578

[51] Int. Cl.[7] ..... F25J 1/00

[52] U.S. Cl. ..... 62/643; 62/652

[58] Field of Search ..... 62/643, 652

[56] References Cited

U.S. PATENT DOCUMENTS

| | | | |
|---|---|---|---|
| 5,613,374 | 3/1997 | Rohde et al. | 62/643 |
| 5,682,761 | 11/1997 | Nagamura et al. | 62/643 |
| 5,743,112 | 4/1998 | Yamamoto et al. | 62/643 |

*Primary Examiner*—William Doerrler

*Attorney, Agent, or Firm*—Young & Thompson

[57] ABSTRACT

There is provided a unit capable of simultaneously producing nitrogen of ultra high purity and oxygen of ultra high purity from air as a feed material. Feed air is introduced into to the bottom 15 of a first rectification column 6. Liquid nitrogen of ultra high purity is recovered from between the upper rectifying part 12 and middle rectifying part 13, and liquid air free of high boiling point components is recovered from between the middle rectifying part 13 and lower rectifying part 14. Oxygen-rich liquid air collected in the bottom 15 is reduced in pressure by an expansion valve 31, and then introduced into a nitrogen condenser 8 as a refrigerant. After a portion of said liquid air is reduced in pressure by an expansion valve 33, it is introduced into the second rectification column 7, where low boiling point components are separated from the top part 21 and liquid oxygen of ultra high purity is recovered from the bottom 23. The remaining portion of said liquid air is reduced in pressure by an expansion valve 32, and then introduced into the nitrogen condenser as a part of the refrigerant. Accordingly, the quantity of a reflux liquid flowing through the lower rectifying part 14 is regulated, and the quantity of said liquid air introduced into the second rectification column 7 is regulated.

8 Claims, 4 Drawing Sheets

ULTRA HIGH PURITY NITROGEN AND OXYGEN GENERATOR UNIT

FIELD OF THE INVENTION

The present invention relates to an ultra high purity nitrogen and oxygen generator unit for simultaneously producing ultra high purity nitrogen and ultra high purity oxygen from air as a feed material by use of rectification columns, and especially to a generator unit for producing ultra high purity nitrogen having an oxygen concentration of 10 ppb or less as an impurity and ultra high purity oxygen having a purity of 99.999995% or more, which can be used in a semiconductor-manufacturing process.

BACKGROUND OF THE INVENTION

FIG. 4 shows a flow sheet of a conventional ultra high purity nitrogen and oxygen generator unit described in the official gazette of Japanese Patent Application Laid-open (KOKAI) No. 296,651/1993. In the drawing, the reference numeral 54 represents a first rectification column, 55 represents a second rectification column, 56 represents a third rectification column, 57 represents a fourth rectification column, 58 represents a nitrogen condenser, 53 represents a main heat exchanger and 59 represents an expansion turbine, respectively.

After feed air is compressed, it is freed of carbon dioxide and moisture, and then cooled down by the main heat exchanger 53, whereby a portion of the feed air is introduced into a lower space part 54*e* of the first rectification column 54 as it is liquefied. The liquid phase portion of the feed air introduced in the lower space part 54*e* collects in the bottom of the lower space part 54*e* and the gas phase portion thereof is caused to rise through the first rectification column 54, i.e. to pass in turn through a lower rectifying part 54*d*, a middle rectifying part 54*c* and an upper rectifying part 54*b* so as to be brought in countercurrent contact with a reflux liquid consisting mainly of liquid nitrogen, which flows down from above. Accordingly, oxygen and mainly components (hydrocarbons, krypton, xenon, etc.) having higher boiling points than that of oxygen in the gas phase are absorbed into the reflux liquid, while nitrogen and mainly components (neon, hydrogen, helium, etc.) having lower boiling points than that of nitrogen in the reflux liquid are evaporated and released into the gas phase. As a result, high purity nitrogen gas containing lower boiling point components collects in the upper space part 54*a* and oxygen-rich liquid air containing higher boiling point components collects in the lower space part 54*e*.

The high purity nitrogen gas collected in the upper space part 54*a* is introduced into the nitrogen condenser 58 so as to be cooled down, and the thus-condensed high purity liquid nitrogen is supplied to the upper rectifying part 54*b* as a reflux liquid again, while non-condensed gas in which the lower boiling point components have been concentrated is discharged out of the system.

A portion of the oxygen-rich liquid air collected in the lower space part 54*e* is introduced into an expansion valve 61, where it is reduced in pressure so as to get oxygen-rich waste gas having a low temperature, and this oxygen-rich waste gas will be introduced into the nitrogen condenser 58 as a refrigerant. The oxygen-rich waste gas discharged from the nitrogen condenser 58 is further introduced into the expansion turbine 59, used in the main heat exchanger 53 as a refrigerant, and then discharged out of the system.

Liquid nitrogen condensed in the nitrogen condenser 58 and supplied to the upper rectifying part 54*b* is brought in countercurrent contact with a rising gas mainly consisting of nitrogen as it is flowing down in the upper rectifying part 54*b*, so as to get ultra high purity liquid nitrogen because the lower boiling point components remaining therein are further released. This ultra high purity liquid nitrogen collects in a reservoir part 54*g* provided between the upper rectifying part 54*b* and the middle rectifying part 54*c*. A portion thereof is extracted out as the ultra high purity liquid nitrogen, reduced in pressure by an expansion valve 63, brought in heat exchange and then supplied to the outside of the system as an ultra high purity nitrogen gas product, and the remaining portion is further caused to flow down through the middle rectifying part 54*c* as a reflux liquid.

Another portion of the oxygen-rich liquid air collected in the lower space part 54*e* is fed to an expansion valve 62, where it is reduced in pressure and partially evaporated so as to get a gas-liquid mixture, and this gas-liquid mixture is supplied to above the rectifying part 55*b* of the second rectification column 55. The gas phase portion of this gas-liquid mixture collects in the upper space part 55*a*, and the liquid phase portion thereof is caused to flow down through the rectifying part 55*b* as a reflux liquid, where it is brought in countercurrent contact with a gas rising from below so as to be enhanced in oxygen concentration, with releasing the lower boiling point components, and collects in the lower space part 55*c*. In the lower space part 55*c* is installed a reboiler 71 for heating liquid collected in the lower space part 55*c* so that components (argon, carbon monoxide, nitrogen, etc.) having lower boiling points than that of oxygen are selectively evaporated together with oxygen, and caused to rise through the rectifying part 55*b*. As a result, liquid oxygen containing higher boiling point components collects in the lower space part 55*c* and gas containing oxygen, nitrogen and lower boiling point components collects in the upper space part 55*a*, and they will be discharged out of the system from the column bottom part and column top part, respectively.

Oxygen gas collected in the gas phase portion above the liquid level of the lower space part 55*c* of the second rectification column 55 is supplied to the lower space part 56*c* of the third rectification column 56. The oxygen gas supplied therein is brought in countercurrent contact with a reflux liquid (high purity liquid oxygen) as it is rising through the rectifying part 56*b*, whereby higher boiling point components are absorbed in the reflux liquid and at the same time, a portion of oxygen in the reflux liquid is evaporated. In the upper space part 56*a* of the third rectification column 56 is installed a condenser 81 for cooling down and condensing gas (high purity oxygen) collected in the upper space part 56*a* and supplying the thus-condensed gas to the rectifying part 56*b* as said reflux liquid. And as a result, liquid oxygen containing a trace of higher boiling point components collects in the lower space part 56*c* and higher purity oxygen gas containing a trace of lower boiling point components collects in the upper space part 56*a*. The liquid oxygen containing higher boiling point components collected in the lower space part 56*c* is returned to the lower space part 55*c* of the second rectification column 55.

High purity-oxygen gas collected in the upper space part 56*a* is supplied to the middle part 57*c* between the upper rectifying part 57*b* and lower rectifying part 57*d* of the fourth rectification column 57. The high purity oxygen gas supplied therein is brought in countercurrent contact with a reflux liquid (high purity liquid oxygen) as it is rising through the upper rectifying part 57*b*, whereby oxygen is absorbed in the reflux liquid and at the same time, lower boiling point components in the reflux liquid are evaporated.

In the upper space part 57*a* of the fourth rectification column 57 is installed a condenser 82 for cooling down and condensing gas (high purity oxygen) collected in the upper space part 57*a* and supplying the thus-condensed gas to the rectifying part 57*b* as said reflux liquid. In the lower space part 57*e*, on the other hand, a reboiler 72 is installed which serves to heat liquid (ultra high purity liquid oxygen) collected in the lower space part 57*e* so that components having lower boiling points than that of oxygen are selectively evaporated together with oxygen and the thus-evaporated components are caused to rise in turn through the lower rectifying part 57*d* and upper rectifying part 57*b* so as to be brought in countercurrent contact with the reflux liquid (high purity liquid oxygen). And as a result, ultra high purity liquid oxygen collects in the lower space part 57*e* and oxygen gas in which the lower boiling point components have been concentrated collects in the upper space part 57*a*. The oxygen gas collected in the upper space part 57*a* will be discharged out of the system from the column top part, and the ultra high purity liquid oxygen collected in the lower space part 57*e* will be recovered as a product and supplied to the outside of the system.

The official gazette of Japanese Patent Application Laid-open (KOKAI) No. 105,088/1988 describes a method of producing nitrogen gas (99.97%) and ultra high purity oxygen gas (99.998%) by use of two rectification columns. According to this method, feed air is fed to the bottom wart of a first rectification column and oxygen-enriched liquid air extracted from a position which is above one equilibrium stage from the lower end of the rectifying part of the first rectification column is fed to the top part of a second rectification column, wherein nitrogen-enriched gas is recovered from the vicinity of the top part of the first rectification column and ultra high purity oxygen gas is recovered from a position which is above one equilibrium stage from the lower end of the rectifying part of the second rectification column (see: FIG. 2 of the official gazette).

Although the unit described in the official gazette of Japanese Patent Application Laid-open (KOKAI) No. 296,651/1993 possesses an advantage that nitrogen of ultra high purity and oxygen of ultra high purity can be produced from one unit only by the liquefaction and rectification of feed air, there are such defects that four rectification columns are required, a piping system is complicated and the operation condition is complicated because of plural condensers and reboilers installed. The method described in the official gazette of Japanese Patent Application Laid-open (KOKAI) No. 105,088/1986 is not one of obtaining ultra high purity nitrogen at the same time.

SUMMARY OF THE INVENTION

Due to consideration of the aforementioned problems, the present invention is intended to provide a generator unit capable of simultaneously producing ultra high purity nitrogen and ultra high purity oxygen by use of a simple construction.

An ultra high purity nitrogen and oxygen generator unit according to the present invention comprises:

- a first rectification column having, in order from above, a first upper space part, an upper rectifying part, a middle rectifying part, a lower rectifying part and a first lower space part;
- a second rectification column having a second upper space part, a rectifying part and a second lower space part;
- a main heat exchanger for cooling down air as a feed material through an indirect heat exchange with a refrigerant, and supplying the thus-cooled air to below said lower rectifying part;
- a nitrogen condenser for cooling down high purity nitrogen gas collected in the first upper space part, which is introduced therein, and supplying the thus-condensed high purity liquid nitrogen to above the upper rectifying part as a reflux liquid and discharging the non-condensed gas out of the system;
- a high purity liquid nitrogen supply pipe for supplying high purity liquid nitrogen as a portion of the reflux liquid to above said upper rectifying part;
- a first expansion valve for reducing the pressure of oxygen-rich liquid air collected in the first lower space part, which is introduced therein, and supplying the thus-generated oxygen-rich waste gas to the nitrogen condenser as a refrigerant;
- a second expansion valve for reducing the pressure of a portion of the reflux liquid which is extracted from between the middle rectifying part and the lower rectifying part, and causing said portion of the reflux liquid reduced in pressure to join with said oxygen-rich waste gas downstream of said first expansion valve;
- an oxygen-rich waste gas pipe for supplying the oxygen-rich waste gas which has been used as a refrigerant in the nitrogen condenser and discharged therefrom to said main heat exchanger as a refrigerant;
- an ultra high purity nitrogen delivery pipe for recovering a portion of the reflux liquid from between the upper rectifying part and the middle rectifying part as ultra high purity liquid nitrogen;
- a third expansion valve for reducing the pressure of a portion of the reflux liquid which is extracted from between the middle rectifying part and the lower rectifying part, and supplying the thus-generated gas-liquid mixture to above the rectifying part of the second rectification column;
- a reboiler placed in the second lower space part for heating liquid collected in the second lower space part to evaporate a portion thereof;
- a waste gas pipe for discharging gas collected in the second upper space part out of the system; and
- an ultra high purity oxygen delivery pipe for recovering liquid collected in the second lower space part as ultra high purity liquid oxygen.

A process for simultaneously producing nitrogen of ultra high purity and oxygen of ultra high purity by use of this unit, will be described here.

Feed air cooled down through an indirect heat exchange with a refrigerant in the main heat exchanger is supplied to below the lower rectifying part of the first rectification column. The feed air supplied therein is caused to rise through the first rectification column, i.e. to pass in turn through the lower rectifying part, the middle rectifying part and the upper rectifying part so as to be brought in countercurrent contact with a reflux liquid (mentioned below) mainly consisting of liquid nitrogen, which flows down from above. Accordingly, oxygen and mainly components (hydrocarbons, krypton, xenon, etc.) having higher boiling points than that of oxygen in the gas phase are absorbed into the reflux liquid, while nitrogen and mainly components (neon, hydrogen, helium, etc.) having lower boiling points than that of nitrogen in the reflux liquid are evaporated and released into the gas phase. As a result, high purity nitrogen gas containing lower boiling point components collects in the first upper space part and oxygen-rich liquid air containing higher boiling point components collects in the first lower space part.

The high purity nitrogen gas collected in the first upper space part is introduced into the nitrogen condenser so as to be cooled down, and the thus-condensed high purity liquid nitrogen is supplied to above the upper rectifying part as the reflux liquid again, while non-condensed gas in which the lower boiling point components have been concentrated is discharged out of the system. As a portion of the reflux liquid, high purity liquid nitrogen will be supplied from the outside of the system to above the upper rectifying part of the first rectification column by way of the high purity liquid nitrogen supply pipe.

The oxygen-rich liquid air collected in the first lower space part is introduced into a first expansion valve, where it is reduced in pressure so as to get oxygen-rich waste gas having a low temperature, and this oxygen-rich waste gas will be introduced into the nitrogen condenser as a refrigerant. The oxygen-rich waste gas used as a refrigerant in the nitrogen condenser is further supplied to the main heat exchanger through the oxygen-rich waste gas pipe, where it is used as a refrigerant for cooling down the feed air and then discharged out of the system.

The high purity liquid nitrogen condensed in the nitrogen condenser and the high purity liquid nitrogen supplied from the outside of the system to above the upper rectifying part are brought in countercurrent contact with a rising gas mainly consisting of nitrogen so as to further release the lower boiling point components remaining therein, as they flow down through the upper rectifying part as a reflux liquid. Then, they enter into between the upper rectifying part and middle rectifying part. Now, a portion of them is recovered as a product of ultra high purity liquid nitrogen by way of the ultra high purity nitrogen delivery pipe, and the remaining portion thereof is caused to flow down as a reflux liquid through the middle rectifying part. A portion of the reflux liquid is extracted out further from between the middle rectifying part and lower rectifying part, and the remaining portion thereof flows down through the lower rectifying part to absorb higher boiling point components in the feed air and then collects in the first lower space part.

The aforementioned reflux liquid extracted out from between the middle rectifying part and lower rectifying part has got liquid air free of higher boiling point components. This reflux liquid is further divided to two routes, where one route of said reflux liquid is introduced into the second expansion valve and the other route thereof is introduced into the third expansion valve. After the reflux liquid introduced in the second expansion valve is reduced in pressure, it is caused to join with the aforementioned oxygen-rich waste gas downstream of the first expansion valve and introduced into the nitrogen condenser as a refrigerant. Accordingly, the quantity of the reflux liquid flowing down through the lower rectifying part of the first rectification column can be regulated to be the required minimum amount, and as a result, the concentration of oxygen in the liquid air introduced into the second rectification column can be enhanced.

The reflux liquid introduced in the third expansion valve is reduced in pressure and partially evaporated so as to get a gas-liquid mixture, and then supplied to above the rectifying part of the second rectification column. The gas phase portion of this gas-liquid mixture collects in the upper space part, and the liquid phase portion thereof flows down as a reflux liquid through the rectifying part so as to release lower boiling point components and to enhance the concentration of oxygen through countercurrent contact with a gas rising from below, and then collects in the lower space part. In the lower space part is installed a reboiler for heating liquid collected in the lower space part so that components (argon, carbon monoxide, nitrogen, etc.) having lower boiling points than that of oxygen are selectively evaporated together with oxygen and the thus-evaporated components are caused to rise through the rectifying part. And as a result, nitrogen gas containing components having lower boiling points than that of oxygen collects in the upper space part and it is discharged out of the system from the top part through the waste gas pipe, and ultra high purity liquid oxygen collects in the lower space part and it is recovered as a product through the ultra high purity oxygen delivery pipe.

In the aforementioned unit, cold of the high purity liquid nitrogen introduced therein from the outside of the system as a portion of the reflux liquid is utilized as a source of cold necessary for the operation of the unit. In place of this source of cold, however, it is also possible to generate cold within the system. In this case, an expansion turbine is installed, and the oxygen-rich waste gas used as a refrigerant in the nitrogen condenser and then discharged therefrom is reduced in pressure by this expansion turbine so that its temperature is caused to drop, and it is then supplied to said main heat exchanger as a refrigerant for cooling down the feed air.

By installation of a fourth expansion valve, cold of the ultra high purity liquid nitrogen can be also recovered. In this case, the ultra high purity liquid nitrogen is introduced into this fourth expansion valve through said ultra high purity nitrogen delivery pipe so as to be reduced in pressure, and the thus-generated ultra high purity nitrogen gas having a low temperature is used as a portion of the refrigerant in said nitrogen condenser and then supplied to the outside of the system as a product.

As a warming source for the reboiler installed in the second lower space part of the second rectification column, in addition, the feed air can be utilized. In this case, a portion of the feed air is introduced as a warming source into the reboiler from the first lower space part, and the thus-cooled and condensed feed air is then returned to said first lower space part.

Further as a warming source for the reboiler installed in the second lower space part of the second rectification column, the high purity nitrogen gas collected in the first upper space part of the first rectification column can be also utilized. In this case, a portion of the high purity nitrogen gas is introduced as a warming source into the reboiler from the first upper space part, and the thus-cooled and condensed high purity liquid nitrogen is then supplied as a portion of the reflux liquid to the upper rectifying part.

DETAILED DESCRIPTION OF THE INVENTION

EXAMPLE 1

Figure 1:
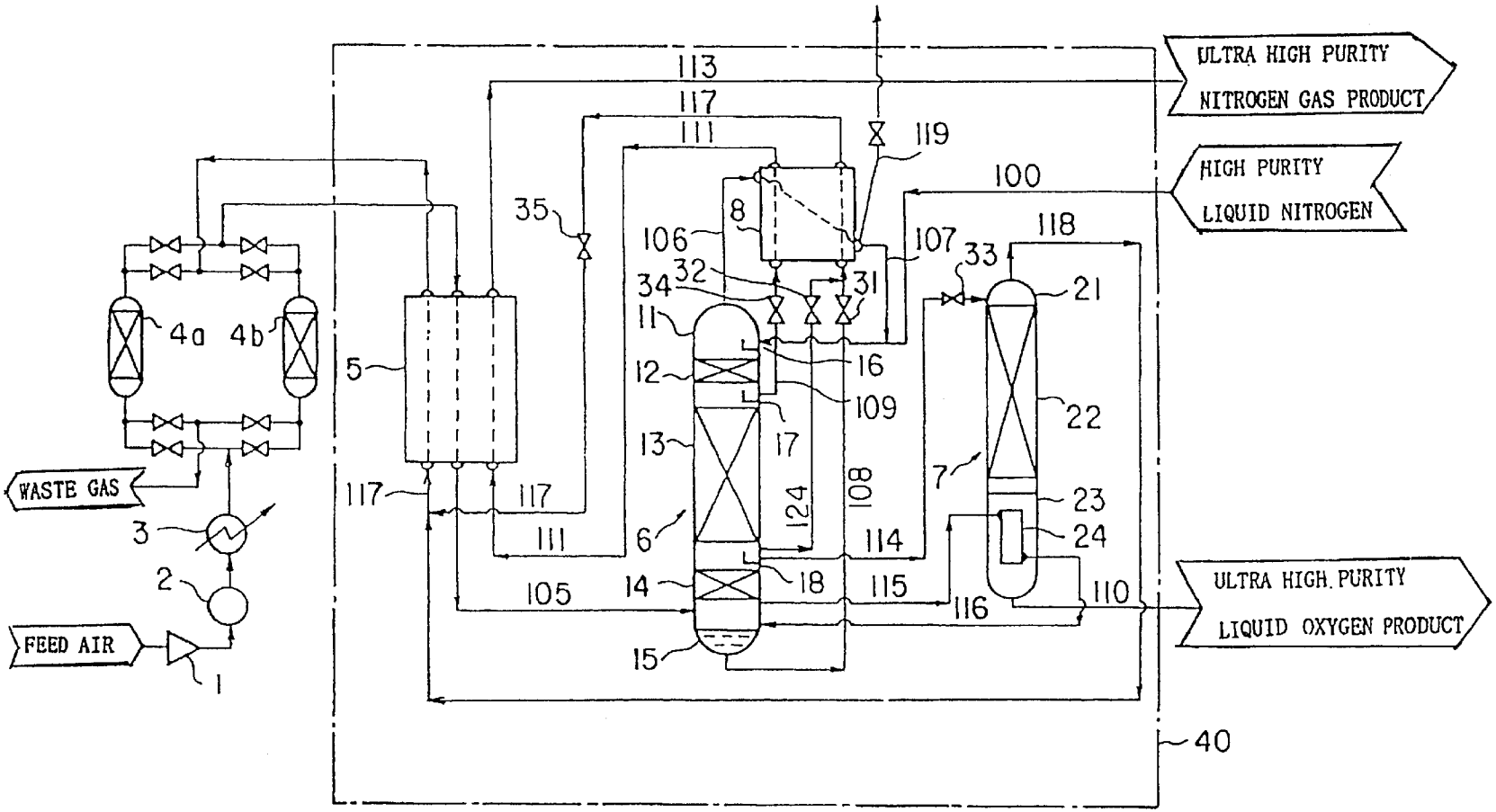
FIG. 1 is a schematic view showing one example of the ultra high purity nitrogen and oxygen generator unit based on the present invention.

FIG. 1 shows a flow sheet of one example of the ultra high purity nitrogen and oxygen generator unit based on the present invention. In the drawing, the reference numeral 5 represents a main heat exchanger, 6 represents a first rectification column, 7 represents a second rectification column, 8 represents a nitrogen condenser, 11 represents a first upper space part, 12 represents an upper rectifying part, 13 represents a middle rectifying part, 14 represents a lower rectifying part, 15 represents a first lower space part, 21 represents a second upper space part, 22 represents a rectifying part, 23 represents a second lower space part, 24 represents a reboiler, 31 represents a first expansion valve, 32 represents a second expansion valve, 33 represents a third expansion valve, 34 represents a fourth expansion valve, 35 represents a fifth expansion valve, 40 represents an insulated box, 100 represents a high purity liquid nitrogen supply pipe, 109 represents an ultra high purity nitrogen delivery pipe, 110 represents an ultra high purity oxygen delivery pipe, 117 represents an oxygen-rich waste gas pipe and 118 represents a waste gas pipe, respectively.

The first rectification column 6 has, in turn from above, the first upper space part 11, the upper rectifying part 12, the middle rectifying part 13, the lower rectifying part 14 and the first lower space part 15, and further has a reservoir part 16 for storing a reflux liquid above the upper rectifying part 12, an upper reservoir part 17 for storing a reflux liquid between the upper rectifying part 12 and middle rectifying part 13 and a lower reservoir part 18 for storing a reflux liquid between the middle rectifying part 13 and lower rectifying part 14. The second rectification column 7 has the second upper space part 21, the rectifying part 22 and the second lower space part 23. The outlet side of a passage route of feed air in the main heat exchanger 5 is connected with the lower space part 15 by way of a pipe 105.

The introduction side of the nitrogen condenser 8 is connected to the top of the first upper space part 21 by way of a pipe 106 and the discharge side thereof is connected to the reservoir part 16 by way of a pipe 107. On the way of said pipe 107 is connected the high purity liquid nitrogen supply pipe 100 for supplying high purity liquid nitrogen as a portion of the reflux liquid from the outside of the system. To the discharge side of the nitrogen condenser 8 is further connected a pipe 119 for discharging non-condensed gas out of the system by way of a gas-liquid separator (not shown).

The first refrigerant supply side of the nitrogen condenser 8 is connected to the bottom of the first lower space part 15 by way of a pipe 108, and said pipe 108 has the first expansion valve 31 provided on its way. The first refrigerant discharge side of the nitrogen condenser 8 is connected to the main heat exchanger 5 by way of the oxygen-rich waste gas pipe 117, and said oxygen-rich waste gas pipe 117 has the fifth expansion valve 35 provided on its way. The second refrigerant supply side of the nitrogen condenser 8 is connected to the upper reservoir part 17 by way of the ultra high purity nitrogen delivery pipe 109, and said ultra high purity nitrogen delivery pipe 109 has the fourth expansion valve 34 provided on its way. The second refrigerant discharge side of the nitrogen condenser 8 is connected to the main heat exchanger 5 by way of a pipe 111.

The lower reservoir part 18 is connected to downstream of the first expansion valve 31 by way of a pipe 124, and said pipe 124 has the second expansion valve 32 provided on its way. Furthermore, the lower reservoir part 18 is connected to above the rectifying part 22 of the second rectification column 7 by way of a pipe 114, and the said pipe 114 has the second expansion valve 32 provided on its way.

In the second lower space part 23 of the second rectification column 7 is installed the reboiler 24. The heating medium supply side of said reboiler 24 is connected to the first lower space part 15 by way of a pipe 115, and the heating medium discharge side thereof is connected to the first lower space part 15 by way of a pipe 116. The top of the second upper space part 21 is connected to the way of the oxygen-rich waste gas pipe 117 by way of the waste gas pipe 118. To the second lower space part 23 is connected the ultra high purity oxygen delivery pipe 110.

In addition, the first rectification column 6, second rectification column 7, nitrogen condenser 8, main heat exchanger 5 and pipes and valves attached thereto are accommodated in the common insulated box 40.

A process for producing nitrogen of ultra high purity and oxygen of ultra high purity by use of this unit will be described here.

After feed air is freed of dust by a filter (not shown), it is compressed to a pressure of about 8.4 $kg/cm^2G$ by a compressor 1. In succession, the feed air is introduced into a carbon monoxide/hydrogen converter 2 filled with an oxidation catalyst, where hydrogen, carbon monoxide and hydrocarbons contained in the feed air are oxidized, the feed air is cooled down by a refrigerator 3, and carbon dioxide and moisture are then removed therefrom by a decarbonating/drying unit 4*a* or 4*b*. Thereafter, the feed air is introduced into a main heat exchanger 5, where it is cooled down to a temperature of about −167° C. through indirect heat exchange with a refrigerant therein, and supplied to the lower rectifying part 14 of the first rectification column 6 through a pipe 105 as it is partially liquefied.

The liquid phase portion of the feed air supplied in the first rectification column 6 collects in the bottom of the first lower space part 15, and the gas phase portion thereof is caused to rise through the first rectification column 6, i.e. to pass in turn through the lower rectifying part 14, middle rectifying part 13 and upper rectifying part 12 so as to be brought in countercurrent contact with a reflux liquid mainly consisting of liquid nitrogen, which flows down from above. Accordingly, oxygen and mainly components (methane, krypton, xenon, etc.) having higher boiling points than that of oxygen in the gas phase are dissolved into the reflux liquid, while nitrogen and components (neon, hydrogen, helium, etc.) having lower boiling points than that of nitrogen in the reflux liquid are evaporated and released into the gas phase. As a result, high purity nitrogen gas containing lower boiling point components collects in the first upper space part 11 and oxygen-rich liquid air containing higher boiling point components collects in the first lower space part 15.

The high purity nitrogen gas containing lower boiling point components, collected in the first upper space part 11, is introduced into the nitrogen condenser 8 through a pipe 106 so as to be cooled down and condensed through indirect heat exchange with a refrigerant, which will be mentioned below, and the thus-condensed high purity liquid nitrogen is returned to the reservoir part 16 above the upper rectifying part 12 as a reflux liquid through a pipe 107, while the non-condensed gas in which the lower boiling point components have been concentrated is discharged out of the system through a gas-liquid separator and a pipe 119.

High purity liquid nitrogen is introduced to the way of the pipe 107 from the ourtside of the system by way of the high purity liquid nitrogen supply pipe 100, and supplied to the reservoir part 16 provided above the upper rectifying part 12. This high purity liquid nitrogen is used as a part of the reflux liquid and utilized as a source of cold required in the rectifying process.

The oxygen-rich liquid air having a temperature of about −168° C., collected in the bottom of the first lower space part 15, is introduced into the first expansion valve 31 by way of a pipe 108, where it is reduced in pressure to a pressure of about 3.2 kg/cm$^2$G and supplied to the nitrogen condenser 8 as the said refrigerant. Oxygen-rich waste gas having a temperature of about −175° C., discharged from the nitrogen condenser 8, is further reduced in pressure to 0.3 kg/cm$^2$G in the fifth expansion valve 35, and introduced into the main heat exchanger 5 through the oxygen-rich waste gas pipe 117, where it is used as a refrigerant to cool down the feed air. After the oxygen-rich waste gas is further used as a regeneration gas for the decarbonating/drying unit 4*a* or 4*b*, it is discharged out of the system.

The high purity liquid nitrogen condensed in the nitrogen condenser 8 and the high purity liquid nitrogen supplied from the outside of the system by way of the high purity liquid nitrogen supply pipe 100 are introduced into the reservoir part 16 above the upper rectifying part 12, and further brought in countercurrent contact with a rising gas mainly consisting of nitrogen so as to get ultra high purity liquid nitrogen, with further releasing the lower boiling point components remaining therein, as they flow down through the upper rectifying part v12, and this ultra high purity liquid nitrogen collects in the upper reservoir part 17 provided between the upper rectifying part 12 and middle rectifying part 13. Now, a portion of the ultra high purity liquid nitrogen is extracted out of the reservoir part 17 by way of the ultra high purity nitrogen delivery pipe 109 and introduced into the fourth expansion valve 34, and remaining portion thereof is caused to further flow down as a reflux liquid through the middle rectifying part 13.

The ultra high purity liquid nitrogen introduced in the fourth expansion valve 34 is reduced in pressure so as to get ultra high purity nitrogen gas having a pressure of about 6.8 kg/cm$^2$G and a temperature of about −173° C., and this ultra high purity nitrogen gas is supplied to the nitrogen condenser 8 as a portion of said refrigerant. The ultra high purity nitrogen gas discharged from the nitrogen condenser 8 is further introduced into the main heat exchanger 5 by way of a pipe 111, where it is used as a portion of the refrigerant to cool down the feed air and then supplied to the outside of the system as an ultra high purity nitrogen gas product by way of a pipe 113.

A portion of the reflux liquid collected in the lower reservoir part 18 provided between the middle rectifying part 13 and lower rectifying part 14, which has got liquid air free of higher boiling point components, further flows down through the lower rectifying part 14 to absorb higher boiling point components in the feed air and then collects in the first lower space part 15, and the remaining portion thereof is extracted out separately in two routes, i.e. through a pipe 124 and through a pipe 114 from the lower reservoir part 18. The reflux liquid extracted out by way of the pipe 124 is introduced into the second expansion valve 32, where it is reduced in pressure to a pressure of about 3.2 kg/cm$^2$G, and it is then caused to join with the aforementioned oxygen-rich waste gas downstream of the first expansion valve 31, and introduced into the nitrogen condenser 8.

On the other hand, the reflux liquid extracted out by way of the pipe 114 is introduced into the third expansion valve 33, where it is reduced in pressure to a pressure of about 0.5 kg/cm$^2$G and partially evaporated so as to get a gas-liquid mixture having a temperature of about −190° C., and this gas-liquid mixture is introduced to above the rectifying part 22 of the second rectification column 7. The gas phase portion of this gas-liquid mixture collects in the second upper space part 21 and the liquid phase portion thereof flows down as a reflux liquid through the rectifying part 22 so as to release lower boiling point components and to enhance the concentration of oxygen through countercurrent contact with a gas rising from below, and then collects in the second lower space part 23. In the second lower space part 23 is installed the reboiler 24, where the feed air is introduced therein as a warming source from the first lower space part 15 by way of a pipe 115 to heat the liquid collected in the second lower space part 23 so that components (argon, carbon monoxide, nitrogen, etc.) having lower boiling points than that of oxygen are selectively evaporated together with oxygen and the thus-evaporated components are caused to rise through the rectifying part. 22. In addition, the feed air which has been used as a warming source in the reboiler 24 is condensed and then returned to the first lower space part 15 by way of a pipe 116.

As a result, nitrogen gas containing components having lower boiling points than that of oxygen collects in the second upper space part 21, and ultra high purity liquid oxygen collects in the second lower space part 23. The nitrogen gas collected in the second upper space part 21 is extracted out of the top part by way of the waste gas pipe 118, caused to join with the oxygen-rich waste gas pipe 117, and then introduced into the main heat exchanger 5 as a refrigerant. On the other hand, the ultra high purity liquid oxygen collected in the second lower space part 23 is recovered as a product by way of the ultra high purity oxygen delivery pipe 110.

EXAMPLE 2

Figure 2:
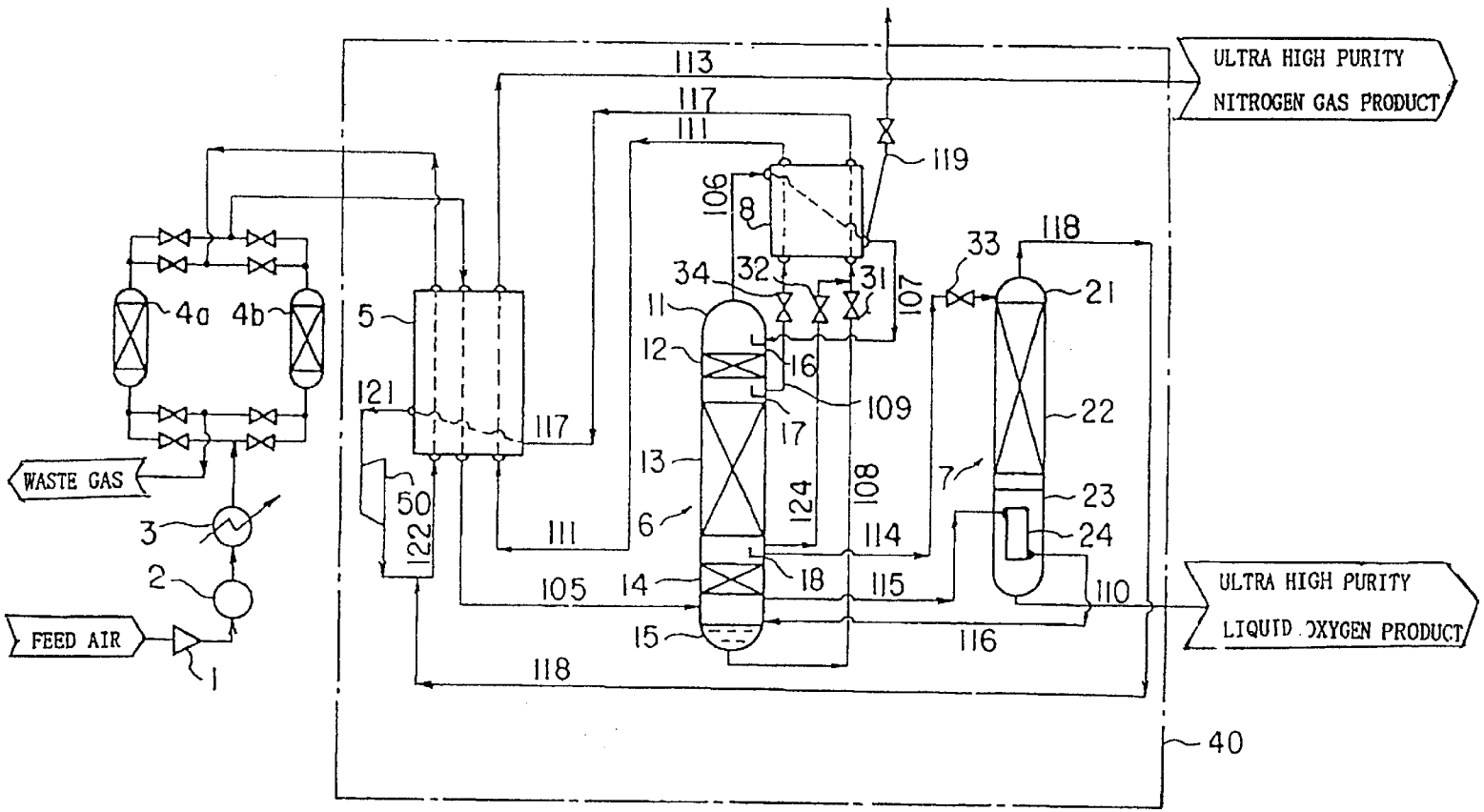
FIG. 2 is a schematic view showing another example of the ultra high purity nitrogen and oxygen generator unit based on the present invention.

FIG. 2 shows a flow sheet of another example of the ultra high purity nitrogen and oxygen generator unit based on the present invention. In the drawing, the reference numeral 50 represents an expansion turbine. In this example, the inlet side of the expansion turbine 50 is connected to an oxygen-rich waste gas take-out port provided on the way of the main heat exchanger 5 by way of a pipe 121, and the outlet side of the expansion turbine 50 is connected to the refrigerant introduction port of the main heat exchanger 5 by way of a pipe 122. If the unit is constructed as mentioned above, in addition, there is no need of introducing high purity liquid nitrogen as a cold source (also as a portion of the reflux liquid) from the outside of the system. Accordingly, there is no pipe which corresponds to the high purity liquid nitrogen supply pipe 100 shown in FIG. 1, and the waste gas pipe 118 is joined with the way of the pipe 122. Except for these points, the unit of this example has the same construction as the unit described in FIG. 1.

The oxygen-rich liquid air having a temperature of about −168° C., collected in the bottom of the first lower space part 15, is introduced into the first expansion valve 31 by way of a pipe 108, where it is reduced in pressure to a pressure of about 3.2 kg/cm$^2$G and supplied to the nitrogen condenser 8 as a refrigerant. The reflux liquid extracted out by way of the pipe 124 from the lower reservoir part 18 is introduced into the second expansion valve 32, where it is reduced in pressure to a pressure of about 3.2 kg/cm$^2$G, and then caused to join with the aforementioned oxygen-rich waste gas downstream of the first expansion valve 31, and supplied to the nitrogen condenser 68 After the oxygen-rich waste gas discharged from the nitrogen condenser 8 is introduced into the main heat exchanger 5 at a temperature of about −175° C. through the oxygen-rich waste gas pipe 117, it is taken out at a temperature of about −150° C. from the way of the main heat exchanger 5 and introduced into the expansion turbine 50 by way of a pipe 121. The oxygen-rich waste gas, which has been reduced in pressure to a pressure of about 0.3 kg/cm$^2$G and caused to drop in temperature to a temperature of about −180° C. in the expansion turbine 50, is again introduced into the main heat exchanger 5 through a pipe 122 so as to be used to cool down the feed air.

By virtue of the installation of the expansion turbine 50, it becomes possible to provide, in the system, cold necessary for operation of the unit, and hence it becomes unnecessary to supply high purity liquid nitrogen as a cold source (also as a reflux liquid) from the outside of the system.

EXAMPLE 3

Figure 3:
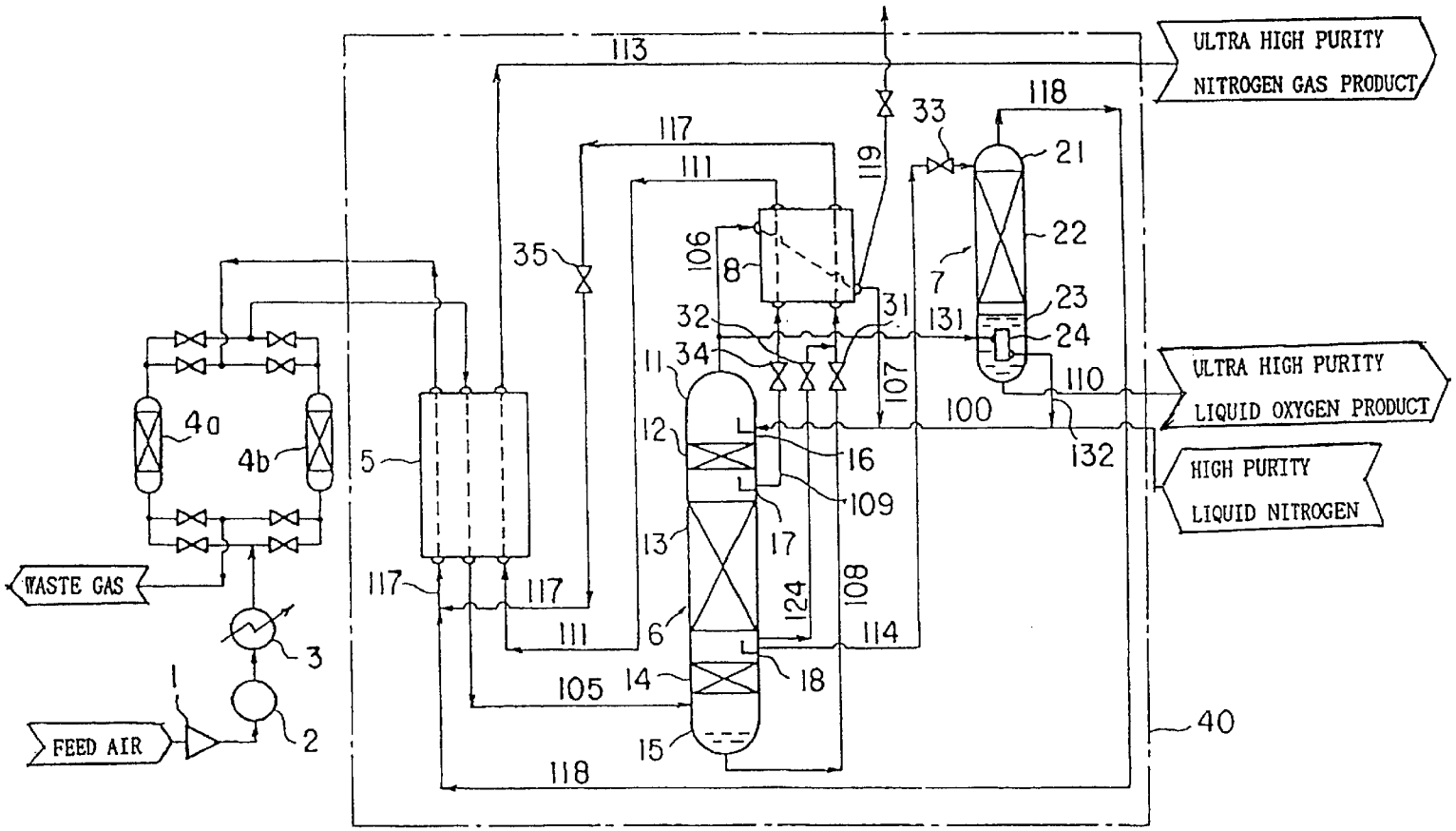
FIG. 3 is a schematic view showing a further example of the ultra high purity nitrogen and oxygen generator unit based on the present invention.
Figure 4:
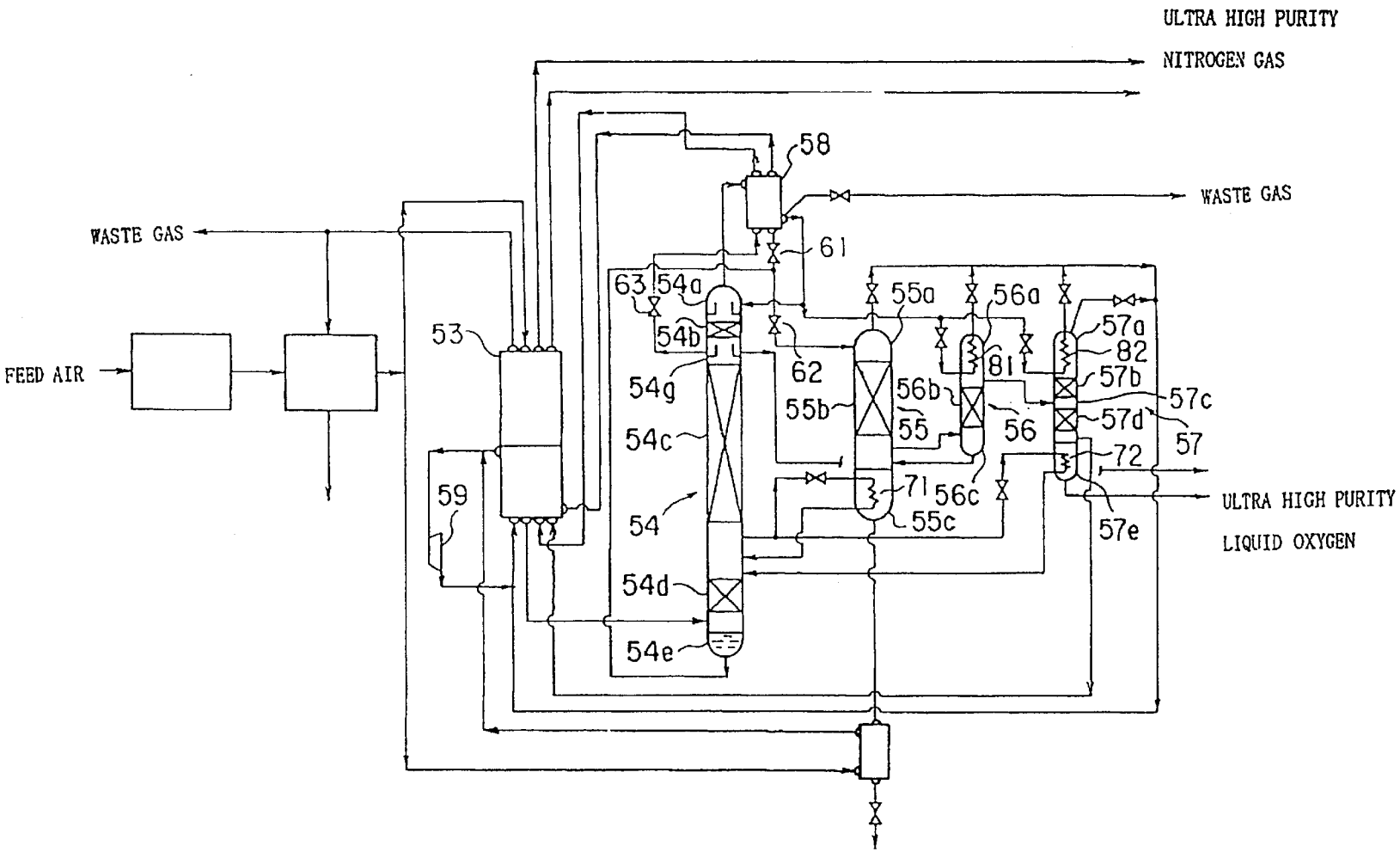
FIG. 4 is a schematic view showing one example of the ultra high purity nitrogen and oxygen generator unit of the prior art.

FIG. 3 shows a flow sheet of a further example of the ultra high purity nitrogen and oxygen generator unit based on the present invention. In this example, the heating medium supply side of the reboiler 24 installed in the second lower space part 23 of the second rectification column 7 is connected to the way of the pipe 106 for sending high purity nitrogen gas from the first upper space part 21 of the first rectification column 6 to the nitrogen condenser 8 by way of a pipe 131, and the heating medium discharge side of the reboiler 24 is connected to the way of the high purity liquid nitrogen supply pipe 100 by way of a pipe 132.

A portion of the high purity nitrogen gas taken out of the first upper space part 11 by way of the pipe 131 is used as a warming source in the reboiler 24 so as to be cooled down, and the thus-condensed high purity liquid nitrogen is returned to the reservoir part 16 above the upper rectifying part 12 through the pipe 132, high purity liquid nitrogen supply pipe 100 and pipe 107 so as to be used as a portion of the reflux liquid.

In the unit based on the present invention, the inner rectifying part of the first rectification column is divided to three stages, where liquid nitrogen of ultra high purity is recovered from between the upper rectifying part and middle rectifying part, and liquid air free of higher boiling point components is recovered from between the middle rectifying part and lower rectifying part. A portion of this liquid air free of higher boiling point components is reduced in pressure, and then supplied to the top part of the second rectification column, where it is brought in countercurrent contact with gas evaporated by the reboiler provided in the bottom of the rectifying part so that lower boiling point components are separated therefrom. Thus, liquid oxygen of ultra high purity is recovered from the bottom of the second rectification column. After the remaining portion of said liquid air is reduced in pressure, it is introduced into the nitrogen condenser as a part of the refrigerant. Accordingly, the quantity of the reflux liquid flowing down through the lower rectifying part of the first rectification column (in use for the separation of high boiling point components) can be regulated to be the required minimum amount, and as a result, the concentration of oxygen in the liquid air introduced into the second rectification column can be enhanced.

Owing to the aforementioned construction, liquid nitrogen of ultra high purity and a proper amount of liquid oxygen of ultra high purity can be simultaneously produced by a relatively simple unit comprising two rectification columns.

Description of Reference Numerals

1. compressor, 2—carbon monoxide/hydrogen converter, 3—refrigerator, 4*a*, 4*b*—decarbonating drying columns, 5—main heat exchanger, 6—first rectification column, 7—second rectification column, 8—nitrogen condenser, 11—first upper space part, 12—upper rectifying part, 13—middle rectifying part, 14—lower rectifying part, 15—first lower space part, 21—second upper space part, 22—rectifying part, 23—second lower space part, 24—reboiler, 31—first expansion valve, 32—second expansion valve, 33—third expansion valve, 34—fourth expansion valve, 35—fifth expansion valve, 40—insulated box, 50—expansion turbine, 60—flow rate regulation valve, 100—high purity nitrogen supply pipe, 108—pipe, 109—ultra high purity nitrogen delivery pipe, 110—ultra high purity oxygen delivery pipe, 117—oxygen-rich waste gas pipe, 118—waste gas pipe, and 124—pipe.

What is claimed is:

1. An ultra high purity nitrogen and oxygen generator unit, which comprises:

a first rectification column having, in order from above, a first upper space part, an upper rectifying part, a middle rectifying part, a lower rectifying part and a first lower space part;

a second rectification column having a second upper space part, a rectifying part and a second lower space part;

a main heat exchanger for cooling down air as a feed material through an indirect heat exchange with a refrigerant, and supplying the thus-cooled air to below said lower rectifying part;

a nitrogen condenser for cooling down high purity nitrogen gas collected in the first upper space part, which is introduced therein, and supplying the thus-condensed high purity liquid nitrogen to above the upper rectifying part as a reflux liquid and discharging the non-condensed gas out of the system;

a high purity liquid nitrogen supply pipe for supplying high purity liquid nitrogen as a portion of the reflux liquid to above said upper rectifying part;

a first expansion valve for reducing the pressure of oxygen-rich liquid air collected in the first lower space part, which is introduced therein, and supplying the thus-generated oxygen-rich waste gas to the nitrogen condenser as a refrigerant;

a second expansion valve for reducing the pressure of a portion of the reflux liquid which is extracted from between the middle rectifying part and the lower rectifying part, and causing said portion of the reflux liquid reduced in pressure to join with said oxygen-rich waste gas downstream of said first expansion valve;

an oxygen-rich waste gas pipe for supplying the oxygen-rich waste gas which has been used as a refrigerant in the nitrogen condenser and discharged therefrom to said main heat exchanger as a refrigerant;

an ultra high purity nitrogen delivery pipe for recovering a portion of the reflux liquid from between the upper rectifying part and the middle rectifying part as ultra high purity liquid nitrogen;

a third expansion valve for reducing the pressure of a portion of the reflux liquid which is extracted from between the middle rectifying part and the lower rectifying part, and supplying the thus-generated gas-liquid mixture to above the rectifying part of the second rectification column;

a reboiler placed in the second lower space part for heating liquid collected in the second lower space part to evaporate a portion thereof;

a waste gas pipe for discharging gas collected in the second upper space part out of the system; and an ultra high purity oxygen delivery pipe for recovering liquid collected in the second lower space part as ultra high purity liquid oxygen.

2. An ultra high purity nitrogen and oxygen generator unit, which comprises:

a first rectification column having, in order from above, a first upper space part, an upper rectifying part, a middle rectifying part, a lower rectifying part and a first lower space part;

a second rectification column having a second upper space part, a rectifying part and a second lower space part;

a main heat exchanger for cooling down air as a feed material through an indirect heat exchange with a refrigerant, and supplying the thus-cooled air to below said lower rectifying part;

a nitrogen condenser for cooling down high purity nitrogen gas collected in the first upper space part, which is introduced therein, and supplying the thus-condensed high purity liquid nitrogen to above the upper rectifying part as a reflux liquid and discharging the non-condensed gas out of the system;

a first expansion valve for reducing the pressure of oxygen-rich liquid air collected in the first lower space part, which is introduced therein, and supplying the thus-generated oxygen-rich waste gas to the nitrogen condenser as a refrigerant;

a second expansion valve for reducing the pressure of a portion of the reflux liquid which is extracted from between the middle rectifying part and the lower rectifying part, and causing said portion of the reflux liquid reduced in pressure to join with said oxygen-rich waste gas downstream of said first expansion valve;

an expansion turbine for reducing the pressure of the oxygen-rich waste gas which has been used as a refrigerant in the nitrogen condenser and discharged therefrom so that its temperature is dropped, and supplying the oxygen-rich waste gas dropped in temperature to said main heat exchanger as a refrigerant;

an ultra high purity nitrogen delivery pipe for recovering a portion of the reflux liquid from between the upper rectifying part and the middle rectifying part as ultra high purity liquid nitrogen;

a third expansion valve for reducing the pressure of a portion of the reflux liquid which is extracted from between the middle rectifying part and the lower rectifying part, and supplying the thus-generated gas-liquid mixture to above the rectifying part of the second rectification column;

a reboiler placed in the second lower space part for heating liquid collected in the second lower space part to evaporate a portion thereof;

a gas discharge pipe for discharging gas collected in the second upper space part out of the system; and an ultra high purity oxygen delivery pipe for recovering a portion of liquid collected in the second lower space part as ultra high purity liquid oxygen.

3. An ultra high purity nitrogen and oxygen generator unit according to claim 1, which further comprises: a fourth expansion valve, where ultra high purity liquid nitrogen is introduced into said fourth expansion valve by way of said ultra high purity nitrogen delivery pipe so as to be reduced in pressure thereby, and the thus-generated ultra high purity nitrogen gas is supplied to said nitrogen condenser as a portion of the refrigerant and then supplied to the outside of the system as a product.

4. An ultra high purity nitrogen and oxygen generator unit according to claim 1, in which said reboiler serves to cool down a portion of the feed air which is introduced therein from said first lower space part as a warming source, and to return the thus-condensed feed air to said first lower space part.

5. An ultra high purity nitrogen and oxygen generator unit according to claim 1, in which said reboiler serves to cool down a portion of the high purity nitrogen gas which is introduced therein from said first upper space part as a warming source, and to supply the thus-condensed high purity liquid nitrogen to above said upper rectifying part as a portion of the reflux liquid.

6. An ultra high purity nitrogen and oxygen generator unit according to claim 2, which further comprises: a fourth expansion valve, where ultra high purity liquid nitrogen is introduced into said fourth expansion valve by way of said ultra high purity nitrogen delivery pipe so as to be reduced in pressure thereby, and the thus-generated ultra high purity nitrogen gas is supplied to said nitrogen condenser as a portion of the refrigerant and then supplied to the outside of the system as a product.

7. An ultra high purity nitrogen and oxygen generator unit according to claim 2, in which said reboiler serves to cool down a portion of the feed air which is introduced therein from said first lower space part as a warming source, and to return the thus-condensed feed air to said first lower space part.

8. An ultra high purity nitrogen and oxygen generator unit according to claim 2, in which said reboiler serves to cool down a portion of the high purity nitrogen gas which is introduced therein from said first upper space part as a warming source, and to supply the thus-condensed high purity liquid nitrogen to above said upper rectifying part as a portion of the reflux liquid.

* * * * *